US011198545B2

(12) United States Patent
Maiwald

(10) Patent No.: US 11,198,545 B2
(45) Date of Patent: Dec. 14, 2021

(54) SYSTEM FOR PACKAGING TWO COMPONENTS

(71) Applicant: SIKA TECHNOLOGY AG, Baar (CH)

(72) Inventor: Dana Maiwald, Zürich (CH)

(73) Assignee: SIKA TECHNOLOGY AG, Baar (CH)

( * ) Notice: Subject to any disclaimer, the term of this patent is extended or adjusted under 35 U.S.C. 154(b) by 0 days.

(21) Appl. No.: 16/959,193

(22) PCT Filed: Feb. 5, 2019

(86) PCT No.: PCT/EP2019/052739
§ 371 (c)(1),
(2) Date: Jun. 30, 2020

(87) PCT Pub. No.: WO2019/154792
PCT Pub. Date: Aug. 15, 2019

(65) Prior Publication Data

US 2020/0399035 A1 Dec. 24, 2020

(30) Foreign Application Priority Data

Feb. 8, 2018 (EP) ..... 18155681

(51) Int. Cl.
*B65D 51/28* (2006.01)
*B65D 25/08* (2006.01)
(Continued)

(52) U.S. Cl.
CPC ..... *B65D 51/28* (2013.01); *B65D 25/08* (2013.01); *B65D 75/5805* (2013.01);
(Continued)

(58) Field of Classification Search
CPC .... B65D 51/28; B65D 25/08; B65D 75/5805; B65D 2577/2091; B65D 81/3233; B65D 81/3216; B65D 81/3244
(Continued)

(56) References Cited

U.S. PATENT DOCUMENTS 3,052,371 A * 9/1962 Van Bemmelen ..... B65D 25/00 220/530
3,743,520 A * 7/1973 Croner ..... B65D 81/3216 426/87
(Continued)

FOREIGN PATENT DOCUMENTS

WO 01/04007 A2 1/2001

OTHER PUBLICATIONS

Mar. 25, 2019 International Search Report issued in International Patent Application No. PCT/EP2019/052739.

*Primary Examiner* — Rafael A Ortiz
(74) *Attorney, Agent, or Firm* — Oliff PLC

(57) ABSTRACT

A system for packaging two liquid components, including a first container for receiving a first component and a lid, by means of which the first container can be closed. The system further includes a second container for receiving a second component, wherein the second container is arranged on the lid such that the second container lies in a volume of the first container when the first container is closed by the lid. The second container additionally has a specified opening which allows the second component to be transferred to the first container in an open state.

16 Claims, 3 Drawing Sheets

(51) Int. Cl.
*B65D 81/32* (2006.01)
*B65D 75/58* (2006.01)

(52) U.S. Cl.
CPC ..... *B65D 81/3216* (2013.01); *B65D 81/3233* (2013.01); *B65D 2577/2091* (2013.01)

(58) Field of Classification Search
USPC ..... 220/506, 502; 206/219, 222
See application file for complete search history.

(56) References Cited

U.S. PATENT DOCUMENTS

| | | | | | |
|---|---|---|---|---|---|
| 3,840,145 | A * | 10/1974 | Almanza | B65D 51/28 | 220/87.1 |
| 4,348,421 | A * | 9/1982 | Sakakibara | A47J 47/14 | 206/217 |
| 5,885,635 | A * | 3/1999 | Spring | B65D 81/3222 | 426/120 |
| 9,360,248 | B1 | 6/2016 | Efferding | | |
| 2002/0139709 | A1 | 10/2002 | Bunyan | | |
| 2006/0191805 | A1* | 8/2006 | Vogel | B65D 51/2864 | 206/222 |
| 2010/0224511 | A1* | 9/2010 | Boatner | B65D 17/401 | 206/222 |
| 2010/0224512 | A1* | 9/2010 | Boatner | B65D 17/4014 | 206/222 |
| 2013/0008897 | A1* | 1/2013 | Rusnak | B65D 43/0231 | 220/23.89 |
| 2013/0037425 | A1* | 2/2013 | Gilleran | B65D 51/28 | 206/216 |
| 2014/0186489 | A1* | 7/2014 | Mahadeo | B65D 81/3211 | 426/2 |

* cited by examiner

SYSTEM FOR PACKAGING TWO COMPONENTS

The present invention relates to a system for packaging two components. In particular, the invention relates to a system for the two components which are mixed by a user before use.

For various uses, products comprise two components which have to be mixed with one another by the user before use. For storage and transport, however, the two components have to be kept separately from one another because, otherwise, the product would react in an undesired way before the use. For example, two-component adhesives which have to be mixed with one another directly before use are often packaged in this way.

Figure 1:
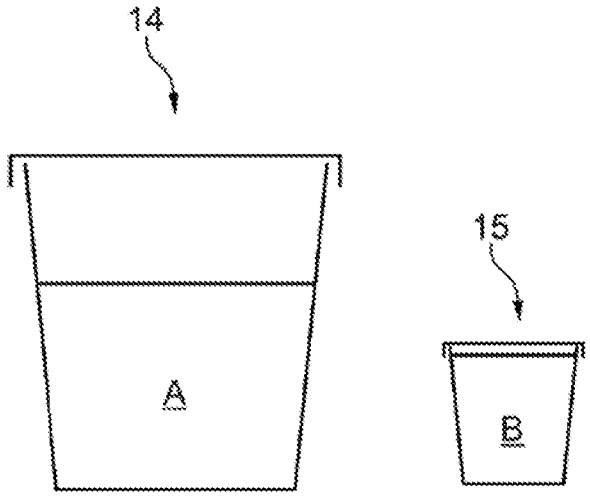

FIG. 1 shows a previously known product for two liquid components. Here, the product comprises a first bucket 14, in which the component A is kept. In addition, the product comprises a second bucket 15, in which a second component B is kept. Before use, the lids of the buckets 14, 15 are then opened, and the liquid component B is emptied into the first bucket 14 to the liquid component A. Afterward, the liquid components A and B are typically mixed with one another by way of a mixing unit, and the two-component product which is produced in this way is used correspondingly.

It is a disadvantage of known products of this type that firstly there is empty space in the first bucket which leads to unnecessarily high storage and transport costs. Secondly, it is additionally disadvantageous that the logistical effort is great because it always has to be ensured that there are in each case a precise number of buckets with the first component and a precise number of buckets with the second component for a use.

Furthermore, there is the risk that, in the case of use, individual components of different two-component products are mixed up if different similar products are used at one location.

It is therefore an object of the present invention to provide an improved system for packaging two components, which system firstly makes lower storage and transport costs possible, and which system secondly reduces the logistical effort for tailoring the product. In addition, the improved system is to be as simple and user-friendly as possible to use.

Said object is achieved by way of a system for packaging two components, the system comprising: a first container for receiving a first component; a lid, by way of which the first container can be closed; and a second container for receiving a second component; the second container being arranged on the lid in such a way that the second container lies in a volume of the first container when the first container is closed by way of the lid; and the second container having a predefined opening apparatus which, in the open state, allows transferring of the second component into the first container.

The solution which is proposed herein affords the advantage that a considerable space saving can be achieved by way of the integration of the second component into the volume of the first container, which leads to substantially lower storage and transport costs. The system which is proposed herein makes it possible to store and to transport the two components separately, and nevertheless to keep the two components in one container, in which the components are additionally mixed with one another before the use.

A further advantage of the system which is proposed herein lies in the fact that a logistical effort can be reduced greatly: the fact that the two components are always packaged with one another ensures automatically that the number of units of the first component and the number of units of the second component are always present in the correct ratio.

The provision of a predefined opening apparatus on the second container ensures that the system is simple to handle for the user. The user can therefore open the second container without great effort and/or without additional tools, in order to transfer the second component into the first container to the first component.

One core concept of the present invention consists in the empty space in the first container below the lid, which empty space is present in the previously known products, being utilized in an optimum way, and the usability of the product being increased at the same time. A further effect of the system which is proposed herein lies in the fact that a saving of waste products and packaging waste can be achieved by way of the more compact arrangement of the components.

The first container can be configured, for example, as a bucket or as a cylindrical container or as a conical container or as a cuboid container or as an irregularly formed container.

In one exemplary embodiment, the system is configured for packaging two liquid components.

In one exemplary alternative embodiment, the system is configured for packaging a liquid and a pasty, pellet-like, granular or pulverulent component. Here, the system can be configured either such that the liquid component is packaged in the first container, or else such that the liquid component is packaged in the second container.

The components can be, for example, a two-component adhesive or a two-component sealant or a two-component primer coat.

Specific examples for components which are to be packaged by way of the system are:

a two-component adhesive, in particular on an epoxy resin basis, such as the product which is available under the commercial name Sikadur® 31;

a two-component sealant, in particular on a polyurethane basis, such as the product which is available under the commercial name Sikafloor® 304; a two-component primer coat, in particular on an epoxy resin basis, such as the product which is available under the commercial name Sikafloor® 156.

A ratio of a volume of the second component to the first component can lie, for example, between 1:100 and 1:1, or between 1:50 and 1:2, or between 1:20 and 1:3.

A ratio of the volume of the second container to a volume of the first container can be, for example, between 1:100 and 1:1, or between 1:50 and 1:2, or between 1:20 and 1:3.

In one exemplary embodiment, a volume of the first container is between 0.5 $dm^3$ and 50 $dm^3$, preferably between 1 $dm^3$ and 30 $dm^3$, preferably between 1.5 $dm^3$ and $dm^3$, particularly preferably between 2 $dm^3$ and 20 $dm^3$.

The provision of a first container with a volume of this type affords the advantage that, as a result, the advantages mentioned at the outset can be utilized, in particular, for two-component materials (such as adhesives, primer coats and sealants) which are typically used in packages with the abovementioned volumes.

The lid is configured, in particular, in such a way that, in the case of a closed lid, the first container is closed in a fluid-tight manner. In order to achieve this, the lid can be equipped, for example, with a screw thread, or the lid can close the first container in the manner of a tin can pull-tab.

In one exemplary embodiment, the second container is of flexible configuration.

For example, the second container can be configured here as a bag.

In one exemplary development, the second container comprises a film for receiving the second component.

Here, the film can have a thickness between 0.1 and 3 mm, preferably between 0.2 and 2 mm, particularly preferably between 0.3 and 1.5 mm.

Furthermore, the film can comprise, for example, polyethylene or polypropylene or polyethylene terephthalate.

In addition, the second container can comprise a single film or a film composite.

The provision of a flexible second container has the advantage that, as a result, firstly low production costs are possible, and secondly flexible containers of this type can be opened in a particularly simple manner, in order to transfer the second component into the first bucket before use of the product.

In one alternative embodiment, the second container is of rigid configuration.

In one exemplary development, the second container is formed at least partially from plastic or from tin sheet or from steel.

The provision of a rigid second container affords the advantage that a more robust packaging can be provided as a result.

In one exemplary embodiment, the predefined opening apparatus comprises a predefined point, along which the opening apparatus can be cut open or can be ripped open or can be broken open.

The provision of a predefined point of this type for opening the second container affords the advantage that, as a result, a user can open the second container with low effort and without an additional tool.

In one exemplary development, the predefined point comprises a pull strip, or the predetermined point forms a predetermined break point or a predetermined tear point.

In one exemplary embodiment, the predefined opening apparatus comprises a preformed spout.

The provision of a preformed spout affords the advantage that, as a result, transferring of the second component into the first container is simplified.

In one exemplary development, the preformed spout is formed in a beak-shaped or point-shaped or conical manner.

In a further exemplary development, the predefined opening apparatus is arranged on a base of the preformed spout.

It is advantageous, in particular, for the preformed spout to be provided at a point of the second container, which point lies at a pouring position of the second container which is as advantageous as possible, for example at a lower end or a lower edge of the second container. Therefore, the second component can be poured comfortably and completely into the first container.

In one exemplary embodiment, the second container and the lid are connected to one another by way of a fluid-tight seam, the lid closing off the second container toward one side, and the lid having a filling apparatus for filling the second container with the second component.

This has the advantage that, as a result, packaging material can be saved because the lid serves at the same time as a closure of the first container and as a closure of the second container.

In one exemplary development, the second container and the lid are configured in one piece.

In one exemplary development, the filling apparatus is configured with a screw closure. In an alternative embodiment, the filling apparatus is welded after filling.

In an alternative exemplary embodiment, the second container forms a volume which is closed in a fluid-tight manner.

This has the advantage that the second container can be filled and sealed before the second container is arranged on the lid. This can be advantageous depending on the production method and product type.

In one exemplary embodiment, the second container is of pre-fillable configuration, filling of the second container with the second component being provided before arranging of the second container on the lid.

In one exemplary embodiment, the system comprises, furthermore, a hook-in apparatus, by way of which the lid can be hooked with the second container on the first container, in order to allow the second component to run out into the first container.

This has the advantage that, as a result, handling of the system is simplified. For example, a user can open a plurality of systems at the same time and can let them run out, without it being necessary in the process for the user to hold the lid with the second container until the second component has run out completely into the first container.

In one exemplary development, the hook-in apparatus is configured as a hook.

In a further exemplary development, the hook-in apparatus is arranged on the lid or on the second container or on the first container.

For example, the hook-in apparatus can be arranged on an inner wall of the first container or, in one alternative embodiment, on an outer side of the lid or, in a further alternative embodiment, on a lower side of the second container.

In one exemplary embodiment, the first container and/or the lid are/is formed at least partially from plastic or from tin sheet or from steel.

A different material can be advantageous for the first container and/or for the lid depending on the product which is used and/or depending on the components which are used.

In one exemplary embodiment, a handle is arranged on the lid, which handle is configured such that it can be folded out.

This has the advantage that the lid with the second container can be handled more simply by the user. Here, furthermore, the system can be stored and/or stacked satisfactorily because the handle scarcely requires additional space in a folded-in state.

In a further exemplary embodiment, a handle is arranged on the lid, which handle does not lie in the volume of the first container when the first container is closed by way of the lid.

This has the advantage that it is ensured as a result that the handle cannot come into contact with the components during transport and storage.

Furthermore, a product is proposed which comprises: a system which is described in the preceding text; a first component which is arranged in the first container; and a second component which is arranged in the second container.

Figure 2A:
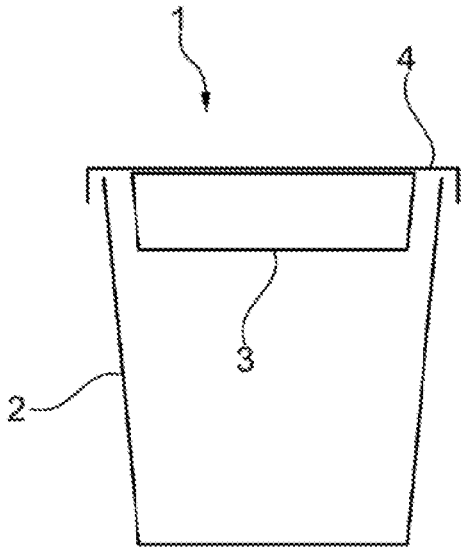
Figure 2B:
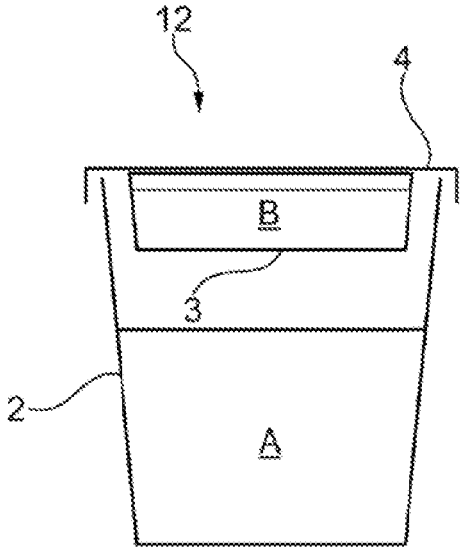
Figure 3A:
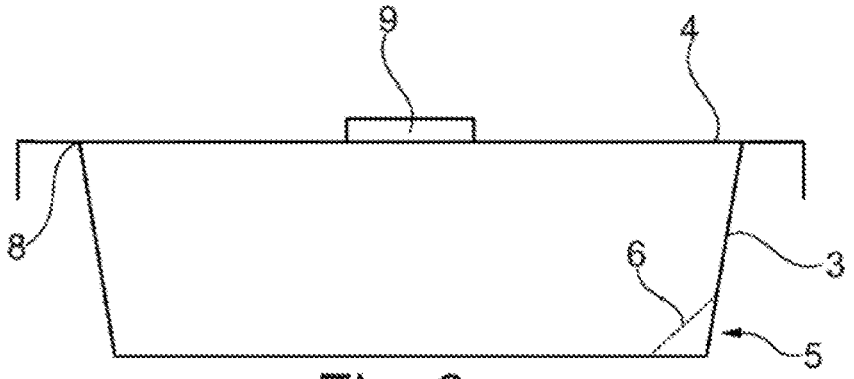
Figure 3B:
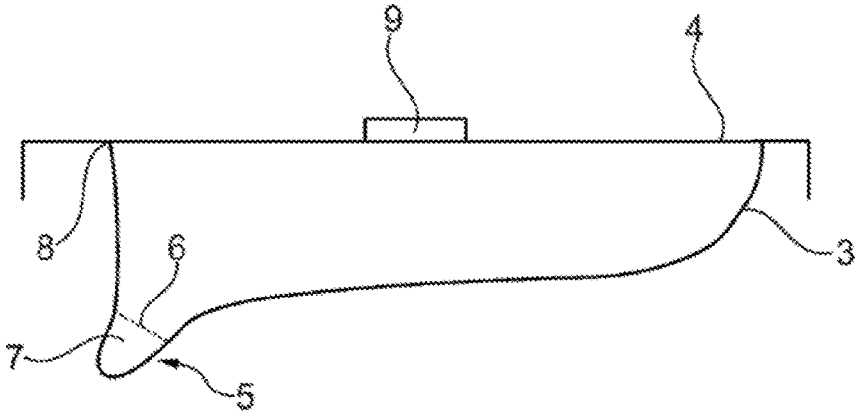
Figure 3C:
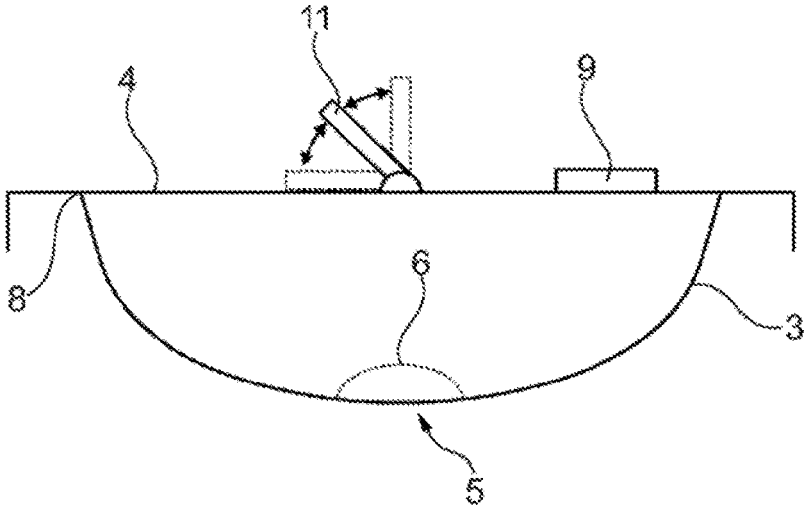
Figure 4A:
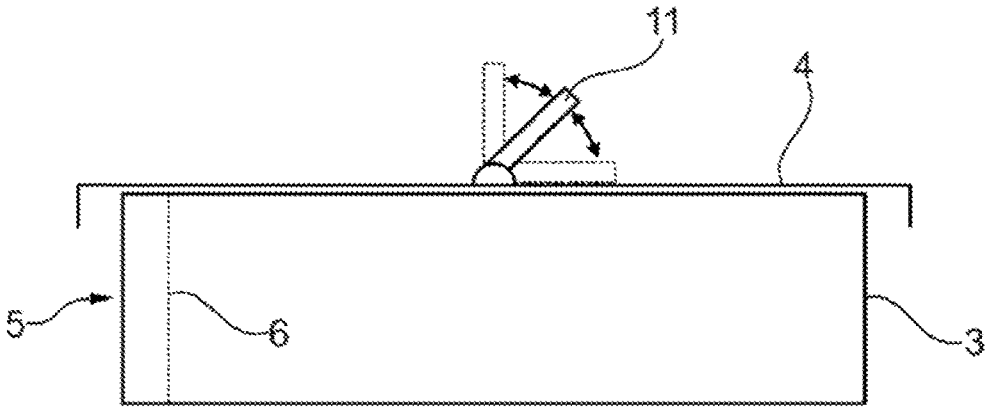
Figure 4B:
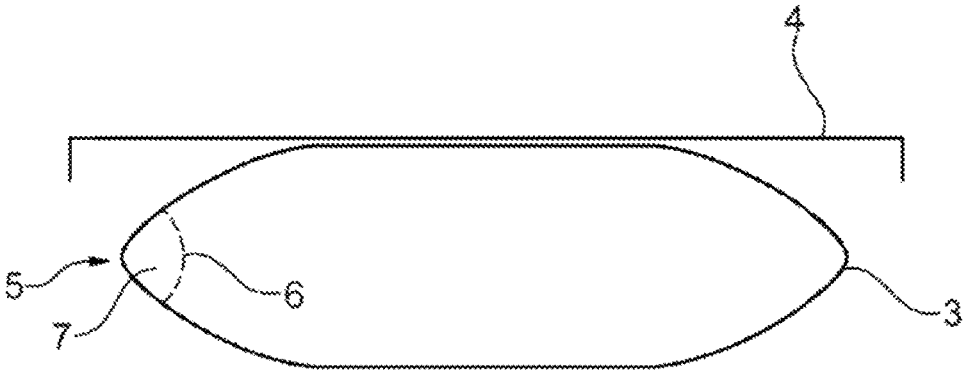
Figure 4C:
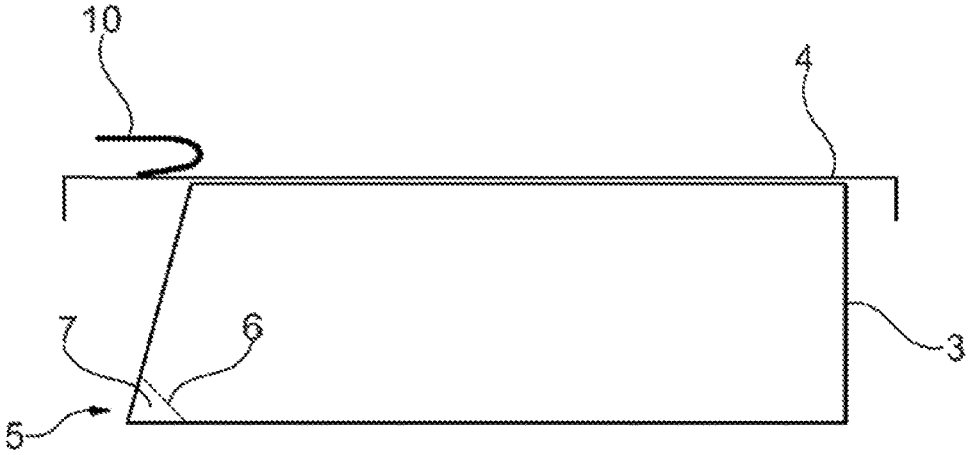

Details and advantages of the invention will be described in the following text using exemplary embodiments and with reference to diagrammatic drawings, in which:

FIG. 1 shows a diagrammatic illustration of a product with two components in accordance with the prior art, FIG. 2*a* shows a diagrammatic illustration of a system for packaging two components, FIG. 2*b* shows a diagrammatic illustration of a product, comprising a system for packaging two components and the components which are arranged therein, FIGS. 3*a* to 3*c* show diagrammatic illustrations of exemplary lids with second containers which are arranged thereon, and FIGS. 4*a* to 4*c* show diagrammatic illustrations of exemplary lids with second components which are arranged thereon.

FIG. 2*a* diagrammatically shows a system 1 for packaging two components. Here, the system 1 comprises a first container 2 which is of bucket-shaped configuration in this exemplary embodiment. The first container 2 is closed by way of a lid 4. A second container 3 is arranged on an inner side of the lid 4. In the case of the use of the system with two components, in order to mix the two components, the lid 4 is removed from the first container 2, the second container 3 is opened, and the second component which is situated in the second container 3 is added into the first container 2 to the first component.

FIG. 2*b* diagrammatically shows a product 12 with a system for packaging two components according to FIG. 2*a*. Furthermore, the product 12 comprises a first component A which is arranged in the first container 2, and a second component B which is arranged in the second container 3. In this exemplary embodiment, in addition to the components A and B, a certain quantity of empty volume is provided in the first container 2, in order that the first container 2 can accommodate the mixture in the case of mixing of the components A, B by way of a dynamic mixer.

Diagrammatically and by way of example, FIGS. 3*a* to 3*c* show different embodiments of a lid 4 with a second container 3 which is arranged thereon. Here, in each case the second container 3 and the lid 4 are connected to one another by way of a fluid-tight seam 8, the lid 4 closing the second container 3 toward one side, and the lid 4 having a filling apparatus 9 for filling the second container 3 with the second component.

Here, in FIG. 3*a*, the second container 3 is configured as a rigid container. In this exemplary embodiment, the predefined opening apparatus 5 is provided at a lower outer edge of the second container 3. Here, the predefined opening apparatus 5 has a predefined point 6, along which the second container 3 can be opened. In this exemplary embodiment, said predefined point 6 is configured as a predetermined break point which, for example, can be broken off or severed or snapped off by a user.

In this exemplary embodiment, the second container 3 and the lid 4 are configured in one piece, with the result that a fluid-tight seam 8 is already produced during the forming of said elements.

The exemplary embodiment in FIG. 3*b* diagrammatically shows an alternative embodiment, in which the second container 3 is configured as a flexible container. The second container 3 and the lid 4 once again form a volume which is closed in a fluid-tight manner for keeping the second component. In this exemplary embodiment, the fluid-tight seam 8 is configured as a welded seam. In this exemplary embodiment, the predefined opening apparatus 5 comprises a preformed spout 7 which is provided at a lower outer end of the second container 3. Here, the predefined point 6 for opening the second container 3 is provided on a base of said preformed spout 7. In said exemplary embodiment, the predefined point 6 is configured in such a way that the second container 3 can be cut open simply in said region.

FIG. 3*c* diagrammatically shows a further exemplary embodiment, in which the second container 3 is once again configured as a flexible container. In contrast to the exemplary embodiment in FIG. 3*b*, the exemplary embodiment in FIG. 3*c* does not have a preformed spout. In the exemplary embodiment of FIG. 3*c*, the predefined opening apparatus 5 is provided at a lower end of the trough-shaped second container 3. In this exemplary embodiment, the predefined point 6 comprises a pull strip, by way of which a user can open the second container 3 by hand without tools.

In this exemplary embodiment, furthermore, the lid 4 comprises a handle 11 which is of foldable configuration. Therefore, the handle 11 can be folded closed for transport and/or for storing of the system, in order not to take up any additional space. For an improvement of the handling during the opening of the system, the handle 11 can be folded open by the user.

FIGS. 4*a* to 4*c* show further diagrammatic exemplary embodiments of a lid 4 and a second container 3 which is arranged thereon, in each case the second container 3 forming a volume which is closed in a fluid-tight manner, and the second container 3 being of pre-fillable configuration, filling of the second container with the second component being provided before arranging of the second container 3 on the lid 4.

In the exemplary embodiment according to FIG. 4*a*, the second container 3 is configured as a rigid container. Here, the second container 3 is cuboid in this exemplary embodiment. The second container 3 once again has a predefined opening apparatus 5 which is provided in a side region of the second container 3 in this exemplary embodiment. The predefined opening apparatus 5 comprises a predefined point 6 which is configured as a predetermined break point in this exemplary embodiment.

In this exemplary embodiment, the lid 4 once again comprises a foldable handle 11.

In this exemplary embodiment, the second container 3 can be hooked in on the lid 4 by way of a hook-in apparatus (not shown).

FIG. 4*b* shows a further exemplary embodiment. Here, the second container 3 is configured as a flexible container, and is configured as a bag in this exemplary embodiment. Here, the second container 3 is adhesively bonded to an inner side of the lid 4. The second container 3 once again comprises a predefined opening apparatus 5 which is provided in a region of a seam of the bag in this exemplary embodiment. Here, said region at the same time forms a preformed spout 7, by way of which the second component can be poured out particularly efficiently. The predefined point 6 is configured as a tear-open seam in this exemplary embodiment.

FIG. 4*c* diagrammatically shows a further exemplary embodiment of a lid 4 with a second container 3. Here, the second container 3 is once again configured as a rigid container which has a trapezoidal cross section. Here, a lower corner of said trapezoidal second container 3 forms the predefined opening apparatus 5 and, at the same time, a preformed spout 7. In this exemplary embodiment, a predefined point 6 is once again configured which comprises an opening aid, such as a predetermined break point.

In addition, a hook-in apparatus 10 is provided in this exemplary embodiment, which hook-in apparatus 10 is arranged on an outer side of the lid 4. The hook-in apparatus 10 is configured as a hook by way of example. As a result, the lid 4 with the second container 3 which is arranged thereon can be hooked on an upper edge of the first container 2, with the result that the second component can flow out into the first container 2, without it being necessary here for a user to hold the lid 4 with the second container 3.

In the case of an alternative embodiment (not shown), the hook-in apparatus 10 is arranged on the second container 3 or on the first container 2.

LIST OF DESIGNATIONS

1 System
2 First container

3 Second container
4 Lid
5 Predefined opening apparatus
6 Predefined point
7 Preformed spout
8 Fluid-tight seam
9 Filling apparatus
10 Hook-in apparatus
11 Handle
12 Product
14 First bucket
15 Second bucket
A First component
B Second component

The invention claimed is:

1. A system for packaging two components, the system comprising:

a first container containing a first component of two components;

a lid, by way of which the first container can be closed; and a second container containing a second component of the two components, wherein the second container is arranged on the lid in such a way that the second container lies in a volume of the first container when the first container is closed by way of the lid, the second container has a predefined opening apparatus which, in the open state, allows transferring of the second component into the first container, and the two components are selected from the group consisting of a two-component adhesive, a two-component sealant, and a two-component primer coat.

2. The system as claimed in claim 1, wherein the second container is of flexible configuration.

3. The system as claimed in claim 2, wherein the second container comprises a film for receiving the second component.

4. The system as claimed in claim 1, wherein the second container is of rigid configuration.

5. The system as claimed in claim 1, wherein the predefined opening apparatus comprises a predefined point, along which the predefined opening apparatus can be cut open or can be ripped open or can be broken open.

6. The system as claimed in claim 1, wherein the predefined opening apparatus comprises a preformed spout.

7. The system as claimed in claim 6, wherein the preformed spout is formed in a beak-shaped or point-shaped or conical manner.

8. The system as claimed in claim 6, wherein the predefined opening apparatus is arranged on a base of the preformed spout.

9. The system as claimed in claim 1, wherein the second container and the lid are connected to one another by way of a fluid-tight seam, the lid closing off the second container toward one side, and the lid having a filling apparatus for filling the second container with the second component.

10. The system as claimed in claim 1, wherein at least one of (i) the second container forms a volume which is closed in a fluid-tight manner, and (ii) the second container is of pre-fillable configuration, filling of the second container with the second component being provided before arranging of the second container on the lid.

11. The system as claimed in claim 1, wherein the system further comprises a hook-in apparatus, by way of which the lid can be hooked with the second container on the first container, in order to allow the second component to run out into the first container.

12. The system as claimed in claim 11, wherein at least one of (i) the hook-in apparatus is configured as a hook, and (ii) the hook-in apparatus is arranged on the lid or on the second container or on the first container.

13. The system as claimed in claim 1, wherein at least one of the first container and the lid is formed at least partially from plastic or from tin sheet or from steel.

14. The system as claimed in claim 1, wherein a handle is arranged on the lid, at least one of (i) the handle being formed such that it can be folded out, and (ii) the handle does not lie in the volume of the first container when the first container is closed by way of the lid.

15. The system as claimed in claim 1, wherein a volume of the first container is in the range of 0.5 $dm^3$ to 50 $dm^3$.

16. A product comprising:

a system as claimed in claim 1;

a first component which is arranged in the first container; and a second component which is arranged in the second container.

* * * * *